US010309079B2

(12) United States Patent
Moriki et al.

(10) Patent No.: US 10,309,079 B2
(45) Date of Patent: Jun. 4, 2019

(54) HYDRAULIC CONTROL SYSTEM FOR WORK MACHINE

(71) Applicant: Hitachi Construction Machinery Co., Ltd., Taito-ku, Tokyo (JP)

(72) Inventors: Hidekazu Moriki, Mito (JP); Shinya Imura, Toride (JP); Kouji Ishikawa, Kasumigaura (JP); Ryohei Yamashita, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 279 days.

(21) Appl. No.: 15/120,559

(22) PCT Filed: Apr. 14, 2015

(86) PCT No.: PCT/JP2015/061486

§ 371 (c)(1),
(2) Date: Aug. 22, 2016

(87) PCT Pub. No.: WO2016/038921

PCT Pub. Date: Mar. 17, 2016

(65) Prior Publication Data

US 2017/0009424 A1 Jan. 12, 2017

(30) Foreign Application Priority Data

Sep. 12, 2014 (JP) ..... 2014-187120

(51) Int. Cl.
*E02F 3/42* (2006.01)
*E02F 9/22* (2006.01)
(Continued)

(52) U.S. Cl.
CPC ..... *E02F 3/422* (2013.01); *E02F 3/425* (2013.01); *E02F 9/2221* (2013.01);
(Continued)

(58) Field of Classification Search
CPC ..... E02F 9/221; E02F 9/2282; E02F 3/422; E02F 3/425; E02F 9/2235; F15B 13/06
(Continued)

(56) References Cited

U.S. PATENT DOCUMENTS 5,829,252 A 11/1998 Hirata et al.
9,790,665 B2 * 10/2017 Tajima ..... E02F 9/2235
(Continued)

FOREIGN PATENT DOCUMENTS

EP 1 743 980 A2 1/2007
EP 2 711 559 A1 3/2014
(Continued)

OTHER PUBLICATIONS

Machine Translation of JP 2013-181286.*
(Continued)

*Primary Examiner* — F Daniel Lopez
*Assistant Examiner* — Daniel S Collins
(74) *Attorney, Agent, or Firm* — Crowell & Moring LLP

(57) ABSTRACT

An object of the present invention is to provide a hydraulic control system for a work machine that is capable of reducing the loss caused by flow division while reducing a decrease in the speed of a hydraulic actuator due to a combined operation. The hydraulic control system for a work machine includes a first hydraulic actuator, one hydraulic pump, a second hydraulic actuator, and another hydraulic pump. The hydraulic control system further includes operating instruction detection means and pump flow control means. The operating instruction detection means detects that operating instructions are issued to the first hydraulic actuator and the second hydraulic actuator. The pump flow control means individually adjusts the delivery flow rate of the one hydraulic pump and the another hydraulic pump in accordance with operation amounts des-
(Continued)

ignated by the operating instructions for the first and second hydraulic actuators. When the first and second hydraulic actuators are simultaneously operated, the pump flow control means increases the delivery flow rate of the one hydraulic pump to a higher rate than when the first hydraulic actuator is operated and the second hydraulic actuator is not operated.

4 Claims, 8 Drawing Sheets

(51) Int. Cl.
*F15B 11/17* (2006.01)
*F15B 13/06* (2006.01)

(52) U.S. Cl.
CPC ..... *E02F 9/2235* (2013.01); *E02F 9/2242* (2013.01); *E02F 9/2282* (2013.01); *E02F 9/2285* (2013.01); *E02F 9/2292* (2013.01); *E02F 9/2296* (2013.01); *F15B 11/17* (2013.01); *F15B 13/06* (2013.01); *F15B 2211/20576* (2013.01); *F15B 2211/255* (2013.01); *F15B 2211/265* (2013.01); *F15B 2211/3059* (2013.01); *F15B 2211/30595* (2013.01); *F15B 2211/6652* (2013.01); *F15B 2211/6654* (2013.01); *F15B 2211/7051* (2013.01); *F15B 2211/7135* (2013.01); *F15B 2211/7142* (2013.01)

(58) Field of Classification Search
USPC ..... 60/428
See application file for complete search history.

(56) References Cited

U.S. PATENT DOCUMENTS

| | | | |
|---|---|---|---|
| 2006/0130473 | A1 | 6/2006 | Kim |
| 2010/0162696 | A1 | 7/2010 | Kakizawa et al. |

FOREIGN PATENT DOCUMENTS

| | | | |
|---|---|---|---|
| EP | 2 803 770 | A1 | 11/2014 |
| JP | 59-194105 | A | 11/1984 |
| JP | 2010-236607 | A | 10/2010 |
| JP | 2013-181286 | A | 9/2013 |
| WO | WO 2008/018538 | A1 | 2/2008 |

OTHER PUBLICATIONS

International Preliminary Report on Patentability (PCT/IB/338 & PCT/IB/373) issued in PCT Application No. PCT/JP2015/061486 dated Mar. 23, 2017, including English translation of document C2 (Japanese-language Written Opinion (PCT/ISA/237)) previously filed on Aug. 22, 2016 (7 pages).

International Search Report (PCT/ISA/210) issued in PCT Application No. PCT/JP2015/061486 dated Jul. 21, 2015 with English translation (four pages).

Japanese-language Written Opinion (PCT/ISA/237) issued in PCT Application No. PCT/JP2015/061486 dated Jul. 21, 2015 (four pages).

Extended European Search Report issued in counterpart European Application No. 15839308.2 dated Apr. 4, 2018 (eight (8) pages).

* cited by examiner

HYDRAULIC CONTROL SYSTEM FOR WORK MACHINE

TECHNICAL FIELD

The present invention relates to a hydraulic control system for a work machine.

BACKGROUND ART

In a hydraulic control system for an excavator or other work machine, a pump delivery amount increases in accordance with the operation amount of an operating device, and at the same time, a spool in a control valve is operated by a pilot pressure based on the operation amount to permit a hydraulic pump to communicate with hydraulic actuators such as a hydraulic cylinder and a hydraulic motor. As the spool in the control valve has an opening formed to vary in accordance with a stroke, the degree of communication between the hydraulic actuators and the hydraulic pump can be changed by the pilot pressure.

Consequently, when a combined operation is performed to simultaneously operate a plurality of hydraulic actuators, the pump delivery amount can be divided to operate in combination the hydraulic actuators in accordance with the operation amounts of individual operating devices.

A hydraulic control circuit for a construction machine that is described, for instance, in Patent Document 1 controls a first pump and a second pump in order to avoid a decrease in an operating speed when a hydraulic actuator for an attachment and another hydraulic actuator operate in combination with each other. The hydraulic control circuit is capable of supplying hydraulic fluid from the first pump to the hydraulic actuator for the attachment and another hydraulic actuator through an associated spool and from the second pump to the hydraulic actuator for the attachment and another hydraulic actuator through an associated spool. The first pump and the second pump are controlled in such a manner that the flow rate obtained when the hydraulic actuator for the attachment and another hydraulic actuator operate in combination with each other is equal to the sum of the flow rate of the hydraulic actuator for an attachment and the flow rate of the other hydraulic actuator.

PRIOR ART LITERATURE

Patent Document

Patent Document 1: JP-2010-236607-A

SUMMARY OF THE INVENTION

Problems to be Solved by the Invention

The above-described prior hydraulic control circuit makes it possible to prevent the operating speed of a hydraulic actuator from decreasing due to an insufficient pump flow rate during a combined operation. This circuit not only provides increased, work efficiency, but also avoids an unnecessary increase in a pump flow rate.

However, when the load pressure of a hydraulic actuator is different from that of the hydraulic actuator for the attachment when they are operated in combination, a flow division loss occurs in the above-described prior hydraulic control circuit in accordance with the pressure difference and flow rate. Consequently, the flow division loss may increase with an increase in the flow rate of a hydraulic pump.

The present invention has been made in view of the above circumstances. An object of the present invention is to provide a hydraulic control system for a work machine that is capable of reducing the loss caused by flow division while reducing a decrease in the speed of a hydraulic actuator due to a combined operation.

Means for Solving the Problems

In accomplishing the above object, according to a first aspect of the present invention, there is provided a hydraulic control system for a work machine including a first hydraulic actuator, one hydraulic pump, a second hydraulic actuator, another hydraulic pump, and a secondary spool for the first hydraulic actuator. The one hydraulic pump is capable of supplying hydraulic fluid to the first hydraulic actuator through a primary spool for the first hydraulic actuator. The another hydraulic pump is capable of supplying hydraulic fluid to the second hydraulic actuator through a primary spool for the second hydraulic actuator. The secondary spool for the first hydraulic actuator is capable of placing the first hydraulic actuator in communication with the another hydraulic pump. The hydraulic control system further includes operating instruction detection means and pump flow control means. The operating instruction detection means detects that operating instructions are issued to the first hydraulic actuator and the second hydraulic actuator. The pump flow control means is capable of adjusting the delivery flow rate of the one hydraulic pump and the delivery flow rate of the another hydraulic pump on an individual basis in accordance with operation amounts designated by the operating instructions for the first and second hydraulic actuators, which are detected by the operating instruction detection means. When the first and second hydraulic actuators are simultaneously operated, the pump flow control means increases the delivery flow rate of the one hydraulic pump to a higher rate than when the first hydraulic actuator is operated and the second hydraulic actuator is not operated.

Advantages of the Invention

According to the present invention, the hydraulic control system for a work machine includes the first hydraulic actuator, the one hydraulic pump, the second hydraulic actuator, the another hydraulic pump, and the secondary spool for the first hydraulic actuator. The one hydraulic pump is capable of supplying hydraulic fluid to the first hydraulic actuator through the primary spool for the first hydraulic actuator. The another hydraulic pump is capable of supplying hydraulic fluid to the second hydraulic actuator through the primary spool for the second hydraulic actuator. The secondary spool for the first hydraulic actuator is capable of placing the first hydraulic actuator in communication with the another hydraulic pump. When the first and second hydraulic actuators are simultaneously operated, the delivery flow rate of the one hydraulic pump increases to a higher rate than when the first hydraulic actuator is operated and the second hydraulic actuator is not operated. Therefore, it is possible to reduce a decrease in the speed of the first hydraulic actuator that is caused by the operation of the second hydraulic actuator. Further, in the above instance, the opening for communication between the first hydraulic actuator and the another hydraulic pump is interrupted.

Consequently, the amount of divided flow of the delivery from the another hydraulic pump can be decreased to reduce the flow division loss.

MODE FOR CARRYING OUT THE INVENTION

Figure 1:
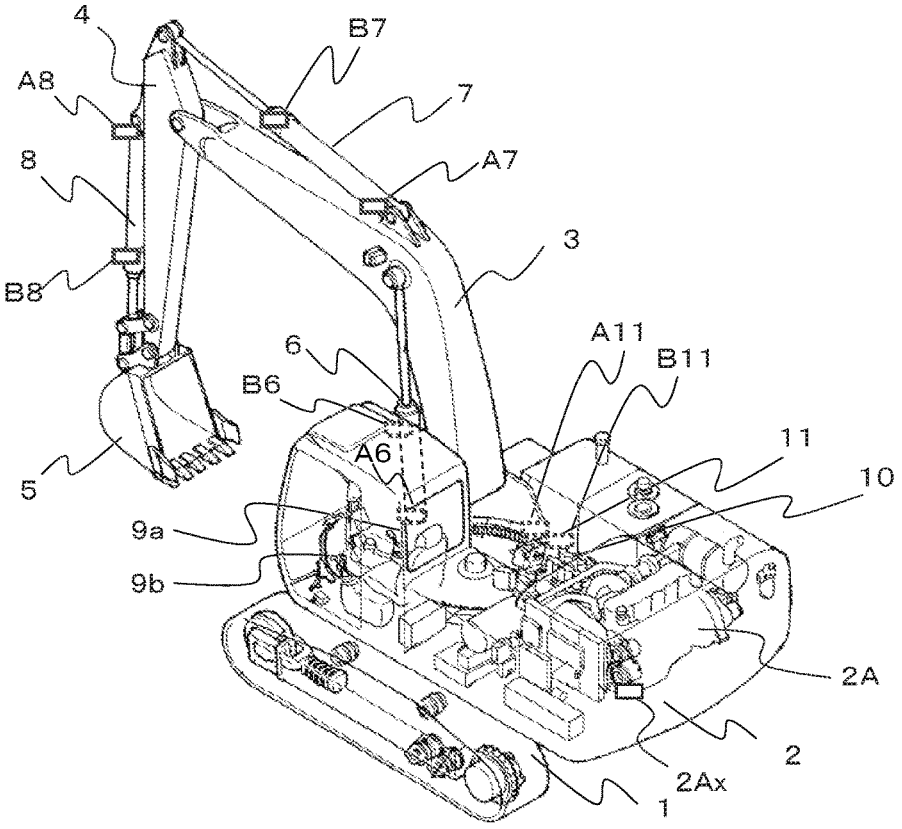
FIG. 1 is a perspective view illustrating a work machine having an embodiment of a hydraulic control system for a work machine in accordance with the present invention.
Figure 2:
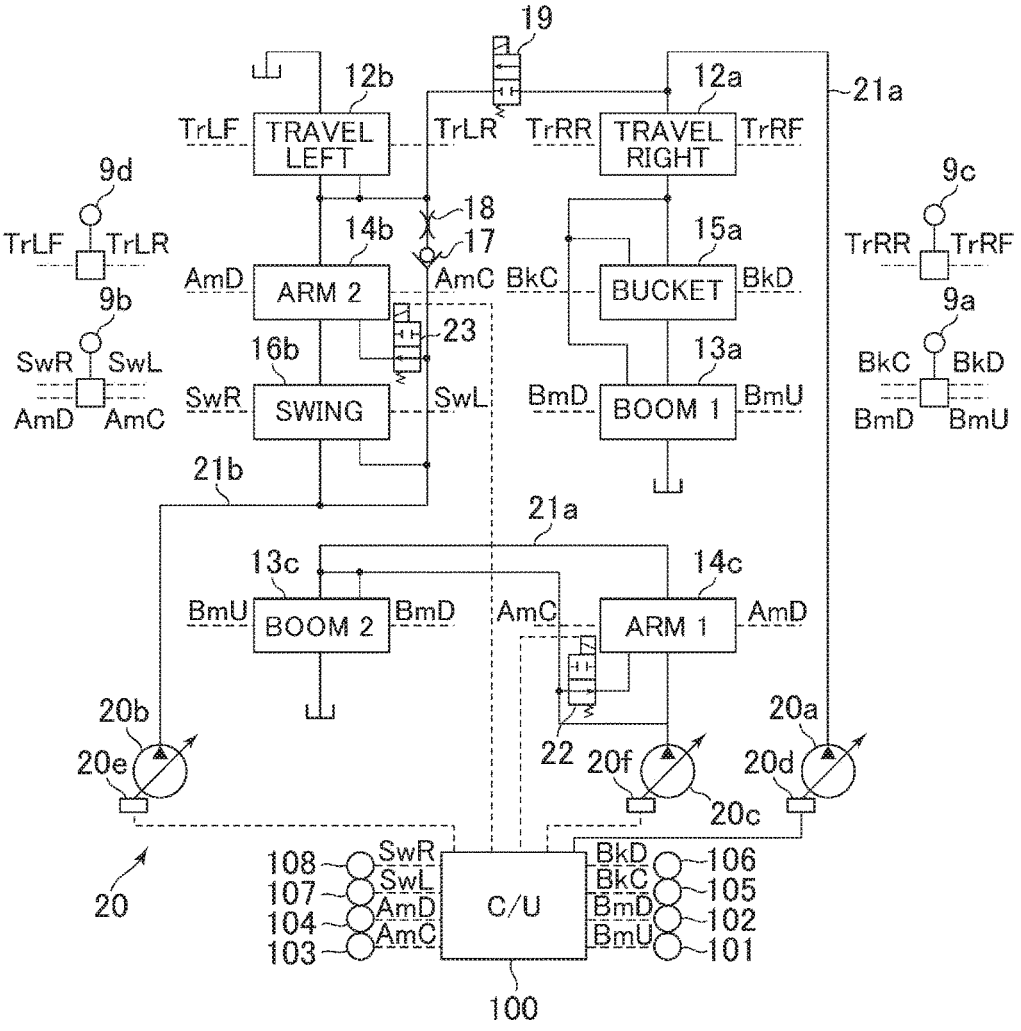
FIG. 2 is a hydraulic control circuit diagram illustrating an embodiment of the hydraulic control system for a work machine in accordance with the present invention.

Embodiments of a hydraulic control system for a work machine according to the present invention will now be described with reference to the accompanying drawings. FIG. 1 is a perspective view illustrating a work machine having an embodiment of the hydraulic control system for a work machine in accordance with the present invention. FIG. 2 is a hydraulic control circuit diagram illustrating an embodiment of the hydraulic control system for a work machine in accordance with the present invention.

As illustrated in FIG. 1, a hydraulic excavator having an embodiment of the hydraulic control system for a work machine in accordance with the present invention includes a lower travel structure 1, an upper swing structure 2, a front work device, and an engine 2A. The upper swing structure 2 is disposed above the lower travel structure 1. The front work device is vertically rotatably connected to the upper swing structure 2. The engine 2A acts as a prime mover. The front work device includes a boom 3, an arm 4, and a bucket 5. The boom 3 is mounted on the upper swing structure 2. The arm 4 is mounted on the leading end of the boom 3. The bucket 5 is mounted on the leading end of the arm 4. The front work device further includes a pair of boom cylinders 6, an arm cylinder 7, and a bucket cylinder 8. The boom cylinders 6 drive the boom 3. The arm cylinder 7 drives the arm 4. The bucket cylinder 8 drives the bucket 5.

In accordance with operations of a first operating lever 9*a* and a second operating lever 9*b*, which are disposed in a cab on the upper swing structure 2, the hydraulic excavator operates in such a manner that hydraulic fluid discharged from a hydraulic pump device not shown is supplied to the boom cylinder 6, the arm cylinder 7, the bucket cylinder 8, and a swing hydraulic motor 11 through a control valve 10. As cylinder rods of the boom cylinder 6, arm cylinder 7, and bucket cylinder 8 are extended and contracted by the hydraulic fluid, the position and orientation of the bucket 5 can be changed. Further, as the swing hydraulic motor 11 is rotated by the hydraulic fluid, the upper swing structure 2 swings with respect to the lower travel structure 1.

The control valve 10 includes various later-described control valves, namely, a travel right directional control valve 12*a*, a travel left directional control valve 12*b*, a boom first directional control valve 13*a*, a boom second directional control valve 13*c*, an arm first directional control valve 14*c*, an arm second directional control valve 14*b*, a bucket directional control valve 15*a*, and a swing directional control valve 16*b*.

The engine 2A includes a revolving speed sensor 2Ax, which detects an engine revolving speed. The boom cylinder 6 includes a pressure sensor A6 and a pressure sensor B6. The pressure sensor A6 detects the pressure in a bottom oil chamber. The pressure sensor B6 detects the pressure in a rod oil chamber. The arm cylinder 7 includes a pressure sensor A7 and a pressure sensor B7. The pressure sensor A7 acts as load acquisition means that detects the pressure in a bottom oil chamber. The pressure sensor B7 detects the pressure in a rod oil chamber. Similarly, the bucket cylinder 8 includes a pressure sensor A8 and a pressure sensor B8. The pressure sensor A8 detects the pressure in a bottom oil chamber. The pressure sensor B8 detects the pressure in a rod oil chamber. The swing hydraulic motor 11 includes pressure sensors A11, B11, which detect left and right swing pressures. Pressure signals detected by the above-mentioned pressure sensors A6-A8, B6-B8, A11, B11 and the engine revolving speed detected by the revolving speed sensor 2Ax are inputted to a later-described controller 100.

As illustrated in FIG. 2, a hydraulic pump device 20 included in an embodiment of the hydraulic control system for a work machine in accordance with the present invention supplies a pilot pressure to each directional control valve, which acts as a spool in the later-described control valve 10, in accordance with operations of the first to fourth operating levers 9*a*-9*d* in order to operate each directional control valve in the control valve 10. The pump device 20 in the hydraulic control system according to the present embodiment includes a first hydraulic pump 20*a*, a second hydraulic pump 20*b*, and a third hydraulic pump 20*c*, which are variable-displacement hydraulic pumps. The first to third hydraulic pumps 20*a*-20*c* are driven by the engine 2A.

The first hydraulic pump 20*a* includes a regulator 20*d*, which is driven by a command signal from the later-described controller 100, and supplies a controlled delivery amount of hydraulic fluid to a first pump line 21*a*. Similarly, the second hydraulic pump 20*b* includes a regulator 20*e*, which is driven by a command signal from the later-described controller 100, and supplies a controlled delivery amount of hydraulic fluid to a second pump line 21*b*. Further, the third hydraulic pump 20*c* includes a regulator 20*f*, which is driven by a command signal from the later-described controller 100, and supplies a controlled delivery amount of hydraulic fluid to a third pump line 21*c*.

For the sake of brevity of explanation, a relief valve, a return circuit, a load check valve, and other elements not directly associated with the present embodiment are omitted from the description. Although the present embodiment is described with respect to a case where the present invention is applied to a publicly known, open center type hydraulic control system, the present invention is not limited to such a hydraulic control system.

The travel right directional control valve 12*a*, the bucket directional control valve 15*a*, and the boom first directional control valve 13*a* are disposed in the first pump line 21*a* that is in communication with a delivery port of the first hydraulic pump 20*a*. A tandem circuit is formed in such a manner as to give priority to the travel right directional control valve 12*a* The remaining bucket directional control valve 15*a* and boom first directional control valve 13*a* are formed as a parallel circuit.

The swing directional control valve 16*b*, the arm second directional control valve 14*b*, and the travel left directional control valve 12*b* are disposed in the second pump line 21*b* that is in communication with a delivery port of the second hydraulic pump 20*b*. The swing directional control valve 16*b* and the arm second directional control valve 14*b* are formed as a parallel circuit, and the travel left directional control valve 12*b* is formed as a parallel-tandem circuit. A check valve 17 and a restrictor 18, which permit only an inflow from the second hydraulic pump 20*b*, are disposed in the parallel circuit of the travel left directional control valve 12*b*. The travel left directional control valve 12*b* is capable of communicating with the first hydraulic pump 20 through a travel communication valve 19.

An arm 2 flow control valve 23 is disposed in the parallel circuit of the second pump line 21*b* and driven by a command from the controller 100.

The boom second directional control valve 13*c* and the arm first directional control valve 14*c* are disposed in the third pump line 21*c* that is in communication with a delivery port of the third hydraulic pump 20*c*. The boom second directional control valve 13*c* and the arm first directional control valve 14*c* are formed as a parallel circuit. An arm 1 flow control valve 22 is disposed in the parallel circuit of the third pump line 21*c* and driven by a command from the controller 100.

An outlet port of the boom first directional control valve 13*a* and an output port of the boom second directional control valve 13*c* are in communication with the boom cylinder 6 through a junction path not shown. An outlet port of the arm first directional control valve 14*c* and an outlet port of the arm second directional control valve 14*b* are in communication with the arm cylinder 7 through a junction path not shown. An outlet port of the bucket directional control valve 15*a* is in communication with the bucket cylinder 5, and an outlet port of the swing directional control valve 16*b* is in communication with the swing hydraulic motor 11.

Referring to FIG. 2, the first to fourth operating levers 9*a*-9*d* each include a pilot valve not shown and generate a pilot pressure in accordance with the amount of tilting operation of each operating lever. The pilot pressure generated by each operating lever is supplied to the operating section of each directional control valve.

Pilot lines indicated by broken lines BkC, BkD are connected from the first operating lever 9*a* to the operating section of the bucket directional control valve 15*a* and respectively used to supply a bucket crowding pilot pressure and a bucket dumping pilot pressure. Further, pilot, lines indicated by broken lines BmD, BmU are connected from the first operating lever 9*a* to the operating sections of the boom first directional control valve 13*a* and boom second directional control valve 13*c* and respectively used to supply a boom raising pilot pressure and a boom lowering pilot pressure.

A pressure sensor 105 for detecting the bucket crowding pilot pressure and a pressure sensor 106 for detecting the bucket dumping pilot pressure are disposed in the pilot lines indicated by the broken lines BkC, BkD. A pressure sensor 101 for detecting the boom raising pilot pressure and a pressure sensor 102 for detecting the boom lowering pilot pressure are disposed in the pilot lines indicated by the broken lines BmD, BmU. The pressure sensors 101, 102, 105, 106 each act as operating instruction detection means. Pressure signals detected by the pressure sensors 101, 102, 105, 106 are inputted to the controller 100.

Pilot lines indicated by broken lines AmC, AmD are connected from the second operating lever 9*b* to the operating sections of the arm first directional control valve 14*c* and arm second directional control valve 14*b* and respectively used to supply an arm crowding pilot pressure and an arm dumping pilot pressure. Further, pilot lines indicated by broken lines SwR, SwL are connected from the second operating lever 9*b* to the operating section of the swing directional control valve 16*b* and respectively used to supply a swing right pilot pressure and a swing left pilot pressure.

A pressure sensor 103 for detecting the arm crowding pilot pressure and a pressure sensor 104 for detecting the arm dumping pilot pressure are disposed in the pilot lines indicated by the broken lines AmC, AmD. A pressure sensor 108 for detecting the swing right pilot pressure and a pressure sensor 107 for detecting the swing left pilot pressure are disposed in the pilot lines indicated by the broken lines SwR, SwL. The pressure sensors 103, 104, 107, 108 act as the operating instruction detection means. Pressure signals detected by the pressure sensors 103, 104, 107, 108 are inputted to the controller 100.

Pilot lines indicated by broken lines TrRF, TrRR are connected from a third lever device 9*c* to the operating section of the travel right directional control valve 12*a* and respectively used to supply a travel right forward pilot pressure and a travel right rearward pilot pressure.

Pilot lines indicated by broken lines TrLF, TrLR are connected from a fourth lever device 9*d* to the operating section of the travel left directional control valve 12*b* and respectively used to supply a travel left forward pilot pressure and a travel left rearward pilot pressure.

The hydraulic control system according to the present embodiment includes the controller 100. The controller 100 inputs the engine revolving speed from the revolving speed sensor 2Ax shown in FIG. 1 and inputs the pilot pressure signal of each pilot line from the aforementioned pressure sensors 101-108. Further, the controller 100 inputs a pressure signal of each actuator from the pressure sensors A6-A8, B6-B8, A11, B11 shown in FIG. 1.

Moreover, the controller 100 controls the delivery flow rates of the hydraulic pumps 20*a*-20*c* by outputting command signals to the regulator 20*d* of the first hydraulic pump 20*a*, to the regulator 20*e* of the second hydraulic pump 20*b*, and to the regulator 20*f* of the third hydraulic pump 20*c*. Additionally, the controller 100 outputs a command signal to the operating section of the arm 1 flow control valve 22 in order to exercise control to reduce the communication opening between the third hydraulic pump 20*c* and the arm cylinder 7 by increasing the magnitude of the command signal. Similarly, the controller 100 outputs a command signal to the operating section of the arm 2 flow control valve 23 in order to exercise control to reduce the communication opening between the second hydraulic pump 20*b* and the arm cylinder 7 by increasing the magnitude of the command signal.

A case where the pressure sensors 101-108 are used as the operating instruction detection means has been described. However, an alternative is to employ the operating levers 9*a*-9*d* as electric levers and use signals from the electric levers as the operating instruction detection means.

Figure 3:
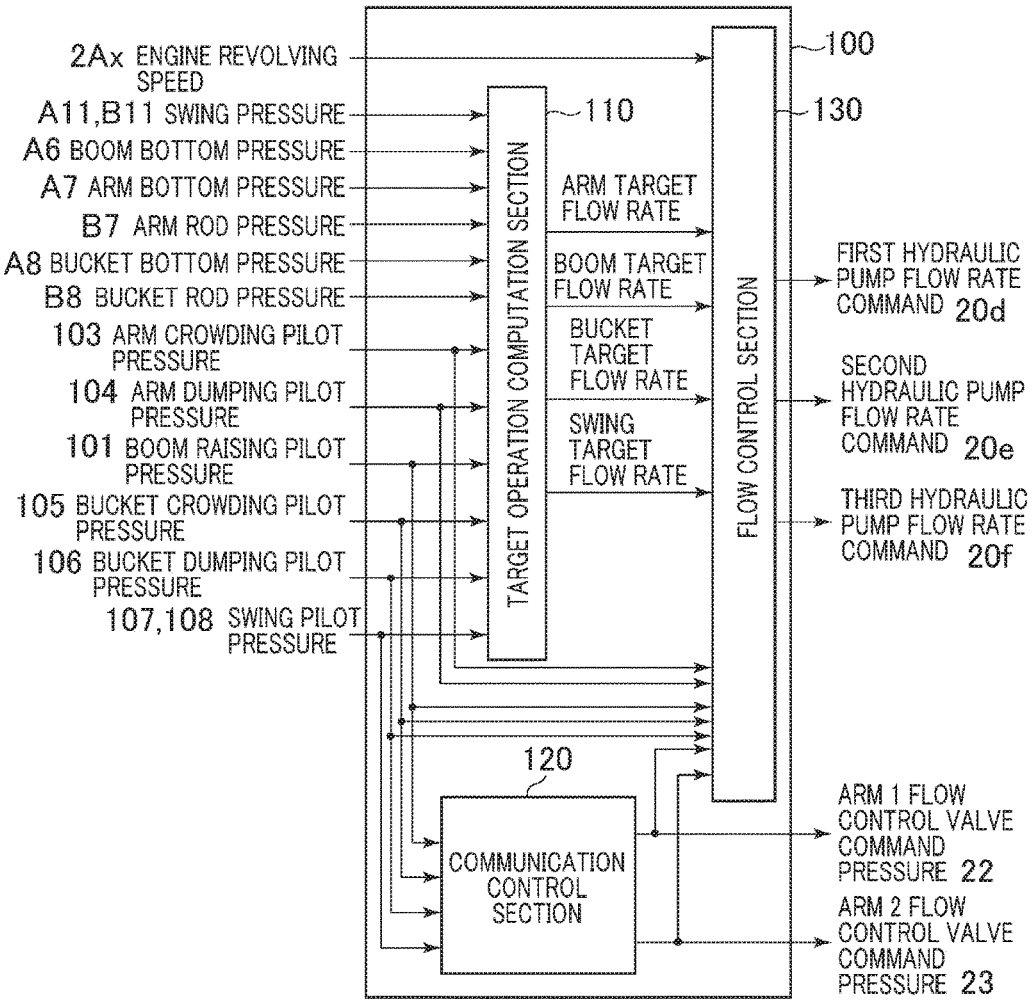
FIG. 3 is a conceptual diagram illustrating a configuration of a controller included in an embodiment of the hydraulic control system for a work machine in accordance with the present invention.
Figure 4:
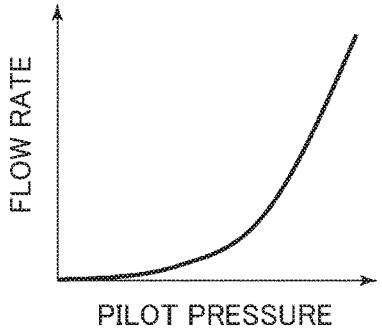
FIG. 4 is a characteristic diagram illustrating an exemplary map of a target operation computation section of the controller included in an embodiment of the hydraulic control system for a work machine in accordance with the present invention.
Figure 5:
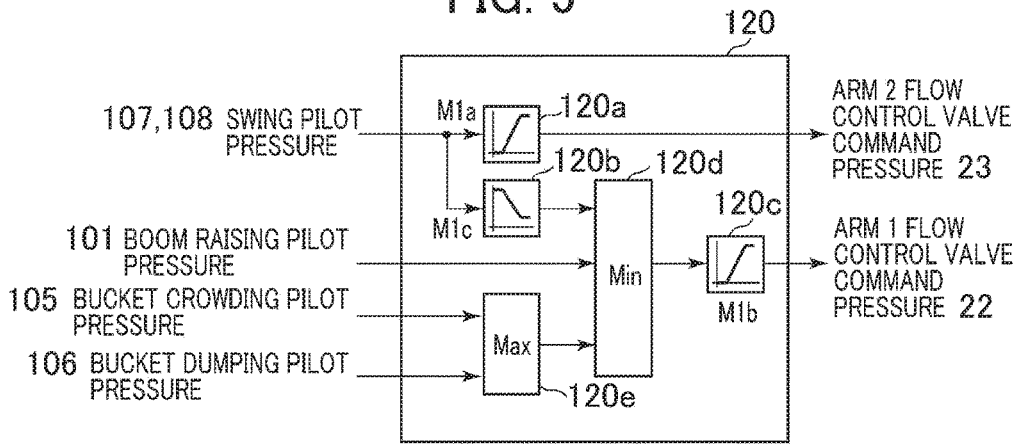
FIG. 5 is a control block diagram illustrating an exemplary computation of a communication control section of the controller included in an embodiment of the hydraulic control system for a work machine in accordance with the present invention.

The controller included in an embodiment of the hydraulic control system for a work machine in accordance with the present invention will now be described with reference to the accompanying drawings. FIG. 3 is a conceptual diagram illustrating a configuration of the controller included in an embodiment of the hydraulic control system for a work machine in accordance with the present invention. FIG. 4 is a characteristic diagram illustrating an exemplary map of a target operation computation section of the controller included in an embodiment of the hydraulic control system for a work machine in accordance with the present invention. FIG. 5 is a control block diagram illustrating an exemplary computation of a communication control section of the controller included in an embodiment of the hydraulic control system for a work machine in accordance with the present invention.

As illustrated in FIG. 3, the controller 100 includes a target operation computation section 110, the communication control section 120, and a flow control section 130. The target operation computation section 110 computes target flow rates from the pilot pressures and load pressures. The communication control section 120 acts as communication control means that computes a command signal of the arm 1 flow control valve 22, which controls the communication of the control valve 10, and a command signal of the arm 2 flow control valve 23. The flow control section 130 acts as pump now control means that calculates flow rate command signals for the first to third hydraulic pumps 20*a*-20*c* in accordance with the target flow rates calculated by the target operation computation section 110, the command signal calculated by the communication control section 120, and the engine revolving speed from the revolving speed sensor 2Ax. The flow control section 130 outputs command signals to the hydraulic pump regulators 20*d*-20*f* in order to control the delivery flow rates of the first to third hydraulic pumps 20*a*-20*c*.

The target operation computation section 110 computes the target flow rates in such a manner as to increase the target flow rates in accordance with an increase in each inputted pilot pressure and decrease the target flow rates in accordance with an increase in each inputted load pressure. During a combined operation, the computations are performed such that the target flow rates are lower than those during an independent operation.

An example of a computation performed by the target operation computation section 110 will now be described by using FIG. 4 and equations. The target operation computation section 110 stores a map for each actuator. The map is used to compute a reference flow rate from a pilot pressure shown in FIG. 4. For example, a swing target flow rate Qsw is calculated from a swing pilot pressure, which is a value obtained when the maximum values of the swing right pilot pressure and swing left pilot pressure are selected. Similarly, an arm crowding reference flow rate Qamc0 is calculated from the arm crowding pilot pressure, and an arm dumping reference flow rate Qamd0 is calculated from the arm dumping pilot pressure.

Meanwhile, a boom raising reference flow rate Qbmu0 is calculated from the boom raising pilot pressure. Further, a bucket crowding reference flow rate Qbkc0 is calculated from the bucket crowding pilot pressure, and a bucket dumping reference flow rate Qbkd0 is calculated from the bucket dumping pilot pressure.

The target operation computation section 110 uses Equation (1) to calculate a boom target flow rate Qbm from the swing target flow rate Qsw.

Equation 1

$$Q_{bm}=\min(Q_{bm0},Q_{bm\ max}-k_{swbm}\cdot Q_{sw}) \quad (1)$$

Qbmmax is an upper-limit value of a boom flow rate and set in accordance with the maximum boom raising speed. Meanwhile, kswbm is a boom flow rate reduction coefficient. The boom target flow rate Qbm decreases with an increase in the swing target flow rate Qsw. The boom flow rate reduction coefficient kswbm may be substituted by a map that causes the boom flow rate upper-limit value Qbmmax to decrease with an increase in the swing target flow rate Qsw.

The target operation computation section 110 uses Equations (2) and (3) to calculate swing power Lsw and boom power Lbm, respectively.

Equation 2

$$L_{sw}=P_{sw}\cdot Q_{sw} \quad (2)$$

Equation 3

$$L_{bm}=P_{bmb}\cdot Q_{bm} \quad (3)$$

Psw is a swing pressure, which is a value obtained when a meter-in pressure is selected from a swing left pressure and swing right pressure detected by the pressure sensors A11, B11. Pbmb is a boom bottom pressure, which is the pressure in the bottom oil chamber of the boom cylinder 6 and detected by the pressure sensor A6.

The target operation computation section 110 uses Equations (4) and (5) to calculate a bucket power upper-limit value Lbkmax and an arm power upper-limit value Lammax, respectively.

Equation 4

$$L_{bk\ max}=k_{bk}(L_{max}-L_{sw}-L_{bm}) \quad (4)$$

Equation 5

$$L_{am\ max}=k_{am}(L_{max}-L_{sw}-L_{bm}) \quad (5)$$

Lmax is a total power upper-limit value of the system, kbk is a bucket power coefficient, and kam is an arm power coefficient. The bucket power coefficient kbk and the arm power coefficient kam are calculated by using the bucket crowding pilot pressure BkC, the bucket dumping pilot pressure BkD, the arm crowding pilot pressure AmC, the arm dumping pilot pressure AmD, and Equation (6).

Equation 6

$$k_{bk}:k_{am}=\max(BkC,BkD):\max(AmC,AmD) \quad (6)$$

The target operation computation section 110 calculates a bucket target flow rate Qbk by using the bucket crowding reference flow rate Qbkc0, the bucket dumping reference flow rate Qbkd0, the bucket power upper-limit value Lbkmax, and Equation (7). Further, the target operation computation section 110 calculates an arm target flow rate Qam by using the arm crowding reference flow rate Qamc0, the arm dumping reference flow rate Qamd0, the arm power upper-limit value Lammax, and Equation (8).

Equation 7

$$Q_{bk}=\min(Q_{bkd0},Q_{bkd0},L_{bk\ max}/P_{bk}) \quad (7)$$

Equation 8

$$Q_{am}=\min(Q_{amd0},Q_{amd0},L_{am\ max}/P_{am}) \quad (8)$$

Pbk is a value obtained when a meter-in pressure is selected from the pressures in the bottom oil chamber and rod oil chamber of the bucket cylinder 8, which are detected by the pressure sensors A8, B8. Meanwhile, Pam is a value obtained when a meter-in pressure is selected from the pressures in the bottom oil chamber and rod oil chamber of the arm cylinder 7, which are detected by the pressure sensors A7, B7.

An exemplary computation performed by the communication control section 120 will now be described with reference to FIG. 5. The communication control section 120 includes a first function generator 120*a*, a second function generator 120*b*, a third function generator 120*c*, a minimum value selection section 120*d*, and a maximum value selection section 120*e*.

As illustrated in FIG. 5, the first function generator 120*a* and the second function generator 120*b* input a swing pilot pressure that represents the maximum value or the swing right pilot pressure and swing left pilot pressure detected by the pressure sensors 107, 108. The first function generator 120*a* stores beforehand a command pressure for the arm 2 flow control valve 23 with respect to the swing pilot pressure as a map M1*a* in a table.

The map M1*a* is characterized such that the arm 2 flow control valve command pressure increases with an increase in the swing pilot pressure. Thus, the opening in the arm 2 flow control valve 23 narrows with an increase in the swing pilot pressure, thereby breaking the communication between the second hydraulic pump 20*b* and the arm cylinder 7. Therefore, when the swing pilot pressure increases, the second hydraulic pump 20*b* drives only the swing hydraulic motor 11. This makes it possible to avoid a flow division loss that is caused by a load pressure difference between the arm cylinder 7 and the swing hydraulic motor 11.

In the description of the present embodiment, breaking the communication signifies that a passage flow rate is substantially reduced to zero, and that the opening is not necessarily completely closed.

The second function generator 120*b* stores beforehand a command pressure for the arm 1 flow control valve 22 with respect to the swing pilot pressure as a map M1*c* in a table. The map M1*c* is characterized such that the arm 1 flow control valve command pressure decreases with an increase in the swing pilot pressure. The second function generator 120*b* outputs a calculated arm 1 flow control valve command pressure to the minimum value selection section 120*d*.

The maximum value selection section 120*e* inputs the bucket crowding pilot pressure and bucket dumping pilot pressure detected by the pressure sensors 105, 106, computes the maximum value of these pressures, and outputs the maximum value to the minimum value selection section 120*d*.

The minimum value selection section 120*d* inputs the arm 1 flow control valve command pressure from the second function generator 120*b*, a signal indicative of the maximum value of the bucket crowding pilot pressure and bucket dumping pilot pressure from the maximum value selection section 120*e*, and the boom raising pilot pressure detected by the pressure sensor 101, and computes the minimum value of these values, and outputs the computed minimum value to the third function generator 120*c*.

The third function generator 120*c* stores beforehand a command pressure for the arm 1 flow control valve 22 with respect to the minimum value of the maximum value of the bucket crowding pilot pressure and bucket dumping pilot pressure and the boom raising pilot pressure as a map M1*b* in a table.

The map M1*b* is characterized such that the arm 1 flow control valve command pressure increases with an increase in the minimum value of the maximum value of the bucket crowding pilot pressure and bucket dumping pilot pressure and the boom raising pilot pressure. Thus, the opening in the arm 1 flow control valve 22 narrows with an increase in the minimum value of the maximum value of the bucket crowding pilot pressure and bucket dumping pilot pressure and the boom raising pilot pressure, thereby breaking the communication between the third hydraulic pump 20*c* and the arm cylinder 7.

Consequently, when the bucket 5 does not perform a combined, operation during a combined aerial operation of the arm 4 and boom 3, the opening in the arm 1 flow control valve 22 is maximized. In this instance, the load pressure of the boom cylinder 6 is higher than that of the arm cylinder 7. Therefore, the delivery hydraulic fluid from the third hydraulic pump 20*c* is supplied only to the arm cylinder 7. Thus, the first hydraulic pump 20*a* can drive only the boom cylinder 6, and the second and third hydraulic pumps 20*b*, 20*c* can drive only the arm cylinder 7.

Meanwhile, when the bucket 5 performs a combined operation during a combined aerial operation of the arm 4 and boom 3, the load pressure of the boom cylinder 6 is higher than that of the bucket cylinder 8. Therefore, the delivery hydraulic fluid from the first hydraulic pump 20*a* is supplied only to the bucket cylinder 8. Thus, the first hydraulic pump 20*a* can drive the bucket cylinder 8, the second hydraulic pump 20*b* can drive the arm cylinder 7, and the third hydraulic pump 20*c* can drive the boom cylinder 6. This makes it possible to avoid a flow division loss that is caused by a load pressure difference.

During a swing operation, however, a value to be inputted to the map M1*b* of the third function generator 120*c* is limited by the map M1*c* of the second function generator 120*b* to a small value in accordance with the swing pilot pressure. Therefore, an opening command pressure for the arm 1 flow control valve 22 does not increase. This prevents the opening in the arm 1 flow control valve 22 from narrowing. As a result, the delivery from the third hydraulic pump 20*c* is divided and supplied to the boom cylinder 6 and to the arm cylinder 7. This ensures the operation of the arm cylinder 7.

Figure 6:
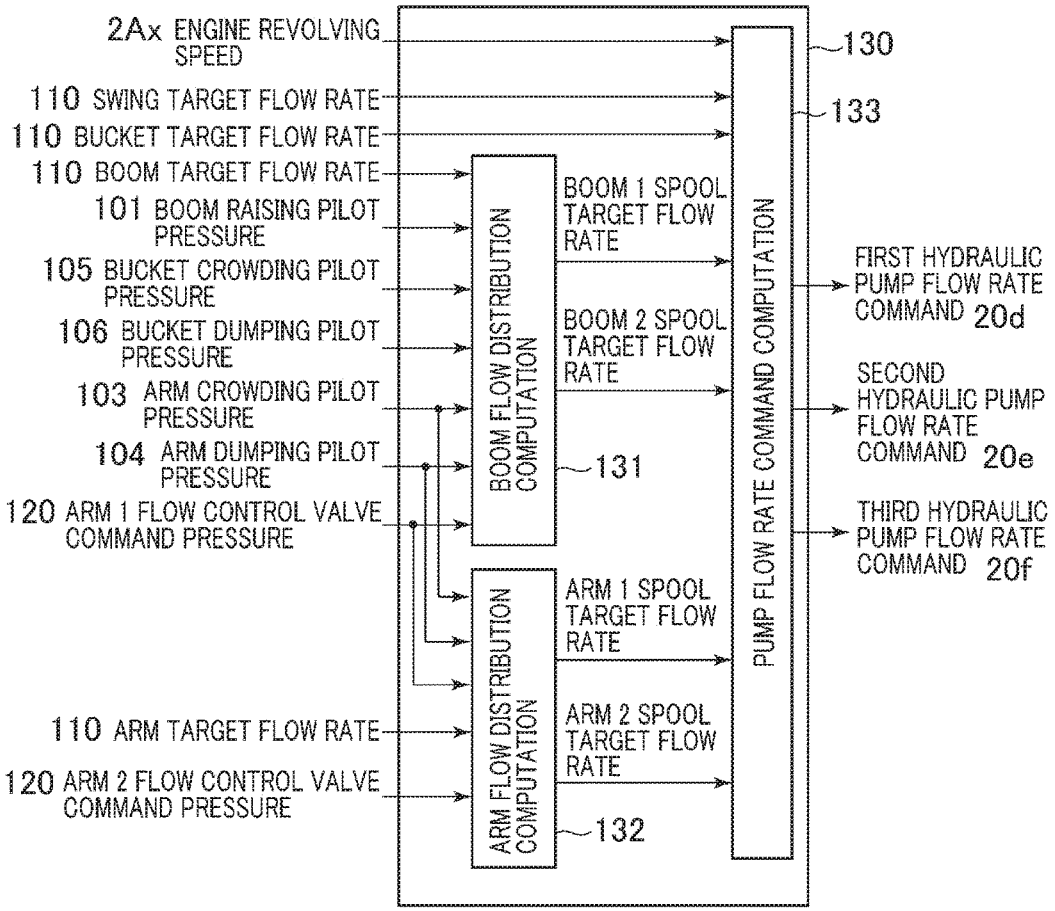
FIG. 6 is a conceptual diagram illustrating a configuration of a flow control section of the controller included in an embodiment of the hydraulic control system for a work machine in accordance with the present invention.
Figure 7:
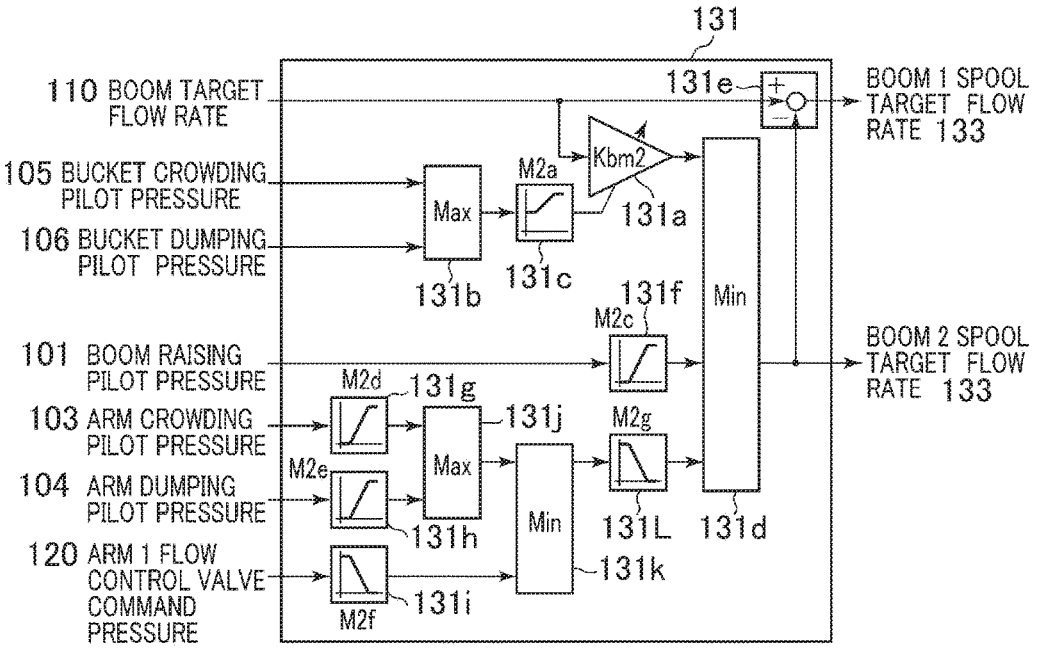
FIG. 7 is a control block diagram illustrating an exemplary computation of a boom flow distribution computation section of the controller included in an embodiment of the hydraulic control system for a work machine in accordance with the present invention.
Figure 8:
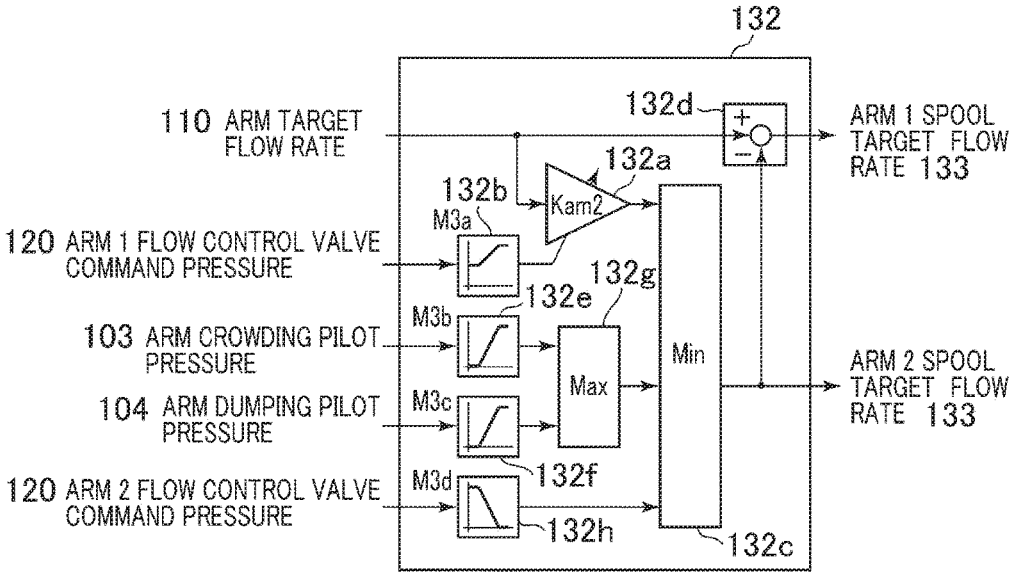
FIG. 8 is a control block diagram illustrating an exemplary computation of an arm target flow distribution computation section of the controller included in an embodiment of the hydraulic control system for a work machine in accordance with the present invention.
Figure 9:
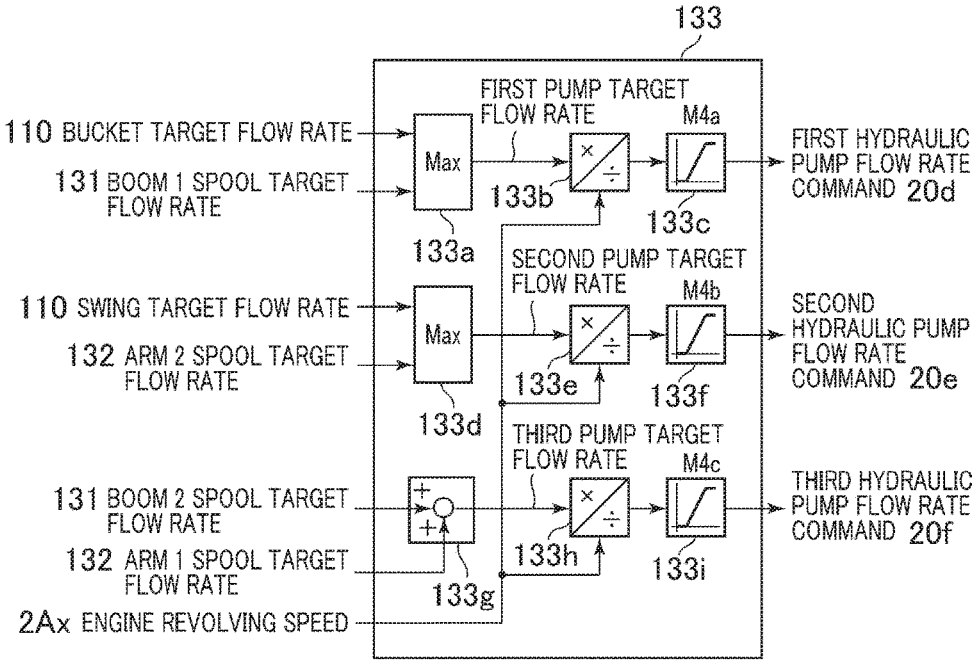
FIG. 9 is a control block diagram illustrating an exemplary computation of a pump flow rate command computation section of the controller included in an embodiment of the hydraulic control system for a work machine in accordance with the present invention.

The flow control section 130, which acts as the pump flow control means, will now be described with reference to the accompanying drawings. FIG. 6 is a conceptual diagram illustrating a configuration of the flow control section of the controller included in an embodiment of the hydraulic control system for a work machine in accordance with the present invention. FIG. 7 is a control block diagram illustrating an exemplary computation of a boom flow distribution computation section of the controller included in an embodiment of the hydraulic control system for a work machine in accordance with the present invention. FIG. 8 is a control block diagram illustrating an exemplary computation of an arm target flow distribution computation section of the controller included in an embodiment of the hydraulic control system for a work machine in accordance with the present invention. FIG. 9 is a control block diagram illustrating an exemplary computation of a pump flow rate command computation section of the controller included in an embodiment of the hydraulic control system for a work machine in accordance with the present invention. Elements that are shown in FIGS. 6 to 9 and designated by the same reference numerals as the elements shown in FIGS. 1 to 5 are identical with the corresponding elements and will not be redundantly described in detail.

As illustrated in FIG. 6, the flow control section 130 includes the boom flow distribution computation section. 131, the arm flow distribution computation section 132, and the pump flow rate command computation section 133. The boom flow distribution computation section 131 distributively computes a target flow rate for each of a plurality of directional control valves of the boom 3. The arm flow distribution computation section 132 distributively computes a target flow rate for each of a plurality of directional control valves of the arm 4. The pump flow rate command computation section 133 calculates the flow rate of each pump in accordance with each of the distributively computed target flow rates and outputs a command signal to the hydraulic pump regulators 20*d*-20*f* in order to control the delivery flow rates of the first to third hydraulic pumps 20*a*-20*c*.

An exemplary computation performed by the boom flow distribution computation section 131 will now be described with reference to FIG. 7. The boom flow distribution computation section 131 includes a variable gain multiplier 131*a*, a first maximum value selection section 131*b*, a first function generator 131*c*, a first minimum value selection section 131*d*, a subtractor 131*e*, a second function generator 131*f*, a third function generator 131*g*, a fourth function generator 131*h*, a fifth function generator 131*i*, a second maximum value selection section 131*j*, a second minimum value selection section 131*k*, and a sixth function generator 131L.

The variable gain multiplier 131*a* inputs the boom target flow rate from the target operation computation section. 110 and multiplies the boom target flow rate by a gain Kbm2 outputted from the first function generator 131*c* to compute a boom 2 spool target flow rate. A signal indicative of the calculated boom 2 spool target flow rate is then outputted to the first minimum value selection section 131*d*.

The first maximum value selection section. 131*b* inputs the bucket crowding pilot pressure and bucket dumping pilot pressure detected by the pressure sensors 105, 106, computes the maximum value of these pressures, and outputs the computed maximum value to the first function generator 131*c*.

The first function generator 131*c* stores beforehand the gain Kbm2, which is based on the maximum value of the bucket crowding pilot pressure and bucket dumping pilot pressure, as a map M2*a* in a table. For example, if the bucket crowding pilot pressure and the bucket dumping pilot pressure are both minimized, the gain Kbm2 may be set to 0.5. If, by contrast, either the bucket crowding pilot pressure or the bucket dumping pilot pressure is maximized, the gain Kbm2 may be set to 1.

The first minimum value selection section. 131*d* inputs a boom 2 spool target flow rate signal from the variable gain multiplier 131*a*, a limit signal from the second function generator 131*f*, and a limit signal from the sixth function generator 131L, computes the minimum value of these signals as the boom 2 spool target flow rate, and outputs the boom 2 spool target flow rate to the subtractor 131*e* and to the pump flow rate command computation section 133.

The subtractor 131*e* inputs the boom target flow rate from the target operation computation section 110 and the boom 2 spool target flow rate from the first minimum value selection section 131*d* and subtracts the boom 2 spool target flow rate from the boom target flow rate to calculate a boom 1 spool target flow rate. A signal indicative of the calculated boom 1 spool target flow rate is then outputted to the pump flow rate command computation section 133.

The second function generator 131*f* inputs the boom raising pilot pressure detected by the pressure sensor 101 and outputs a limit signal to the first minimum value selection section 131*d*. An upper-limit value for the boom 2 spool target flow rate with respect to the boom raising pilot pressure is stored in the second function generator 131*f* as a map M2*c* in a table beforehand. The map M2*c* is substantially proportional to the area of the opening in the boom second directional control valve 13*c* and increases in accordance with the boom raising pilot pressure. That is to say, the upper-limit value for the boom 2 spool target flow rate increases in accordance with area of the opening in the boom second directional control valve 13*c*.

The third function generator 131*g* inputs the arm crowding pilot pressure detected by the pressure sensor 103, acquires a signal from a map M2*d* stored in a table, and outputs the acquired signal to the second maximum value selection section 131*j*. The map M2*d* indicates the area of a crowding opening in the arm first directional control valve 14*c* with respect to the arm crowding pilot pressure.

The fourth function generator 131*h* inputs the arm dumping pilot pressure detected by the pressure sensor 104, acquires a signal from a map M2*e* stored in a table, and outputs the acquired signal to the second maximum value selection section 131*j*. The map M2*e* indicates the area of a dumping opening in the arm first directional control valve 14*c* with respect to the arm dumping pilot pressure.

The second maximum value selection section 131*j* inputs the output of the third function generator 131*g* and the output of the fourth function generator 131*h*, computes the maximum value of these outputs, and outputs the computed maximum value to the second minimum value selection section. 131*k*.

The fifth function generator 131*i* inputs an arm 1 flow control valve command pressure signal from the communication control section 120, acquires a signal from a map M2*f* stored in a table, and outputs the acquired signal to the second minimum value selection section 131*k*. The map M2*f* indicates the area of the opening in the arm 1 flow control valve 22 with respect to the arm 1 flow control valve command pressure.

The second minimum value selection section 131*k* inputs a signal indicative of the maximum value of the output of the third function generator 131*g* and the output of the fourth function generator 131*h*, which are obtained from the second maximum value selection section 131*j*, and an output signal of the fifth function generator 131*i*, computes the minimum value of these signals, and outputs the computed minimum value to the sixth function generator 131L.

The sixth function generator 131L inputs a signal from the second minimum value selection section 131*k* and outputs a limit signal to the first minimum value selection section 131*d*. A limit value for the boom 2 spool target flow rate with respect to the minimum value of the maximum value of values computed from the arm crowding pilot pressure and arm dumping pilot pressure by using the maps M2*d*, M2*e* and a value computed from the arm 1 flow control valve command pressure by using the map M2*f* is stored in the sixth function generator 131L as a map M2*g* in a table.

That is to say, the boom 2 spool target flow rate is limited to a small value in accordance with a value computed by using the map M2*g*. This limits the boom 2 spool target flow rate in accordance with the degree of communication between the third hydraulic pump 20*c* and the arm cylinder 7.

An exemplary computation performed by the arm flow distribution computation section 132 will now be described with reference to FIG. 8. The arm flow distribution computation section 132 includes a variable gain multiplier 132*a*, a first function generator 132*b*, a minimum value selection section 132*c*, a subtractor 132*d*, a second function generator 132*e*, a third function generator 132*f*, a maximum value selection section 132*g*, and a fourth function generator 132*h*.

The variable gain multiplier 132*a* inputs the arm target flow rate from the target operation computation section. 110 and multiplies the arm target flow rate by a gain Kam2 outputted from the first function generator 132*b* to compute an arm 2 spool target flow rate. A signal indicative of the calculated arm 2 spool target flow rate is then outputted to the minimum value selection section 132*c*.

The first function generator 132*b* inputs an arm 1 flow control valve command pressure signal from the communication control section 120, handles a signal obtained from a map M3*a* stored in a table as a gain Kam2, and outputs the gain Kam2 to the variable gain multiplier 132*a*. For example, if the arm 1 flow control valve command pressure signal indicates the minimum pressure, the gain Kam2 may be set to 0.5. If, by contrast, the arm 1 flow control valve command pressure signal indicates the maximum pressure, the gain Kam2 may be set to 1.

The minimum value selection section 132*c* inputs an arm 2 spool target flow rate signal from the variable gain multiplier 132*a*, a limit signal from the later-described maximum value selection section 132*g*, and a limit signal from the fourth function generator 132*h*, computes the minimum value of these signals, and outputs the computed minimum value, as the arm 2 spool target flow rate, to the subtractor 132*d* and to the pump flow rate command computation section 133.

The subtractor 132*d* inputs the arm target flow rate from the target operation computation section. 110 and the arm 2 spool target flow rate from the minimum value selection section 132*c*, and subtracts the arm 2 spool target flow rate from the arm target flow rate to calculate an arm 1 spool target flow rate. A signal indicative of the calculated arm 1 spool target flow rate is then outputted to the pump flow rate command computation section 133.

The second function generator 132*e* inputs the arm crowding pilot pressure detected by the pressure sensor 103, acquires a signal from a map M3*b* stored in a table, and outputs the acquired signal to the maximum value selection section 132*g*. The map M3*b* is substantially proportional to the area of a crowding opening in the arm second directional control valve 14*b* with respect to the arm crowding pilot pressure.

The third function generator 132*f* inputs the arm dumping pilot pressure detected by the pressure sensor 104, acquires a signal from a map M3*c* stored in a table, and outputs the acquired signal to the maximum value selection section 132*g*. The map M3*c* is substantially proportional to the area of a dumping opening in the arm second directional control valve 14*b* with respect to the arm dumping pilot pressure.

The maximum value selection section 132*g* inputs the output of the second function generator 132*e* and the output of the third function generator 132*f*, computes the maximum value of these outputs, and outputs the computed maximum value to the minimum value selection section 132*c*.

The fourth function generator 132*h* inputs an arm 2 flow control valve command pressure signal from the communication control section 120, acquires a signal from a map M3*d* stored in a table, and outputs the acquired signal to the minimum value selection section 132*c*. The map M3*d* is substantially proportional to the area of the opening in the arm 2 flow control valve 23 with respect to the arm 2 flow control valve command pressure.

That is to say, the arm 2 spool target flow rate is limited in accordance with the maximum value of values computed from the arm crowding pilot pressure and arm dumping pilot pressure by respectively using the maps M3*b*, M3*c*, and with a value computed from the arm 2 flow control valve command pressure by using the map M3*d*. This increases the upper-limit value for the arm 2 spool target flow rate in accordance with the degree of communication between the second hydraulic pump 20*b* and the arm cylinder 7.

An exemplary computation performed by the pump flow rate command computation section 133 will now be described with reference to FIG. 9. The pump flow rate command computation section 133 includes a first maximum value selection section 133*a*, a first divider 133*b*, a first function generator 133*c*, a second maximum value selection section 133*d*, a second divider 133*e*, a second function generator 133*f*, a subtractor 133*g*, a third divider 133*h*, and a third function generator 133*i*.

The first maximum value selection section 133*a* inputs a bucket target flow rate signal from the target operation computation section 110 and a boom 1 spool target flow rate signal from the boom flow distribution computation section. 131, computes the maximum value of these signals, and outputs the computed maximum value, as a first pump target flow rate, to the first divider 133*b*.

The first divider 133*b* inputs the first pump target flow rate from the first maximum value selection section 133*a* and the engine revolving speed detected by the revolving speed sensor 2Ax, and divides the first pump target flow rate by the engine revolving speed to calculate a first pump target command. A signal indicative of the calculated first pump target command is then outputted to the first function generator 133*c*.

The first function generator 133*c* inputs the first pump target command signal calculated by the first divider 133*b*, acquires a signal from a map M4*a* stored in a table, and outputs the acquired signal to the regulator 20*d* as a first pump flow rate command signal. This controls the delivery flow rate of the first hydraulic pump 20*a*.

The second maximum value selection section 133*d* inputs a swing target flow rate signal from the target operation computation section 110 and an arm 2 spool target flow rate signal from the arm flow distribution computation section 132, computes the maximum value of these signals, and outputs the computed maximum value, as a second pump target flow rate, to the second divider 133*e*.

The second divider 133*e* inputs the second pump target flow rate from the second maximum value selection section. 133*d* and the engine revolving speed detected by the revolving speed sensor 2Ax, and divides the second pump target flow rate by the engine revolving speed to calculate a second pump target command. A signal indicative of the calculated second pump target command is then outputted to the second function generator 133*f*.

The second function generator 133*f* inputs the second pump target command signal calculated by the second divider 133*e*, acquires a signal from a map M4*b* stored in a table, and outputs the acquired signal to the regulator 20*e* as a second pump flow rate command signal. This controls the delivery flow rate of the second hydraulic pump 20*b*.

The subtractor 133*g* inputs the boom 2 spool target flow rate signal from the boom flow distribution computation section 131 and an arm 1 spool target flow rate signal from the arm flow distribution computation section 132, and adds the boom 2 spool target flow rate signal to the arm 1 spool target flow rate signal to calculate a third pump target flow rate. A signal indicative of the calculated third pump target flow rate is then outputted to the third divider 133*h*.

The third divider 133*h* inputs the third pump target flow rate from the subtractor 133*g* and the engine revolving speed detected by the revolving speed sensor 2Ax, and divides the third pump target flow rate by the engine revolving speed to calculate a third pump target command. A signal indicative of the calculated third pump target command is then outputted to the third function generator 133*i*.

The third function generator 133*i* inputs the third pump target command signal calculated by the third divider 133*b*, acquires a signal from a map M4*c* stored in a table, and outputs the acquired signal to the regulator 20*f* as a third pump flow rate command signal. This controls the delivery flow rate of the third hydraulic pump 20*c*.

The present embodiment is described on the assumption that the reduction ratio between the engine 2A and each hydraulic pump is 1. If the reduction ratio is other than 1, it is necessary to perform computations in accordance with the reduction ratio.

Figure 10:
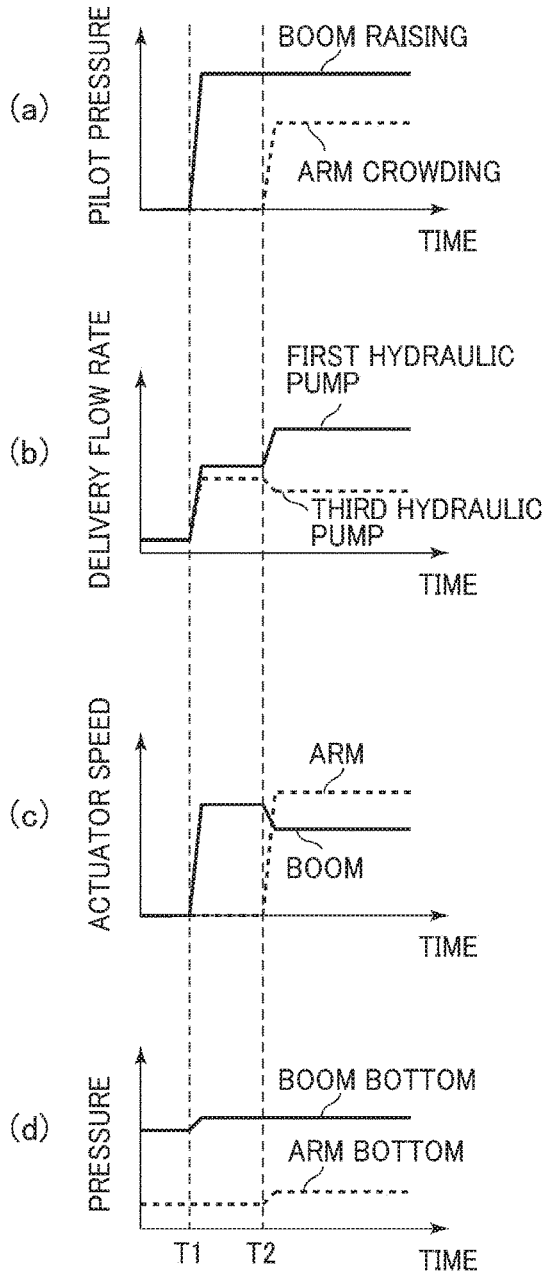
FIG. 10 is a characteristic diagram illustrating an exemplary operation related to pump flow control means in an embodiment of the hydraulic control system for a work machine in accordance with the present invention.
Figure 11:
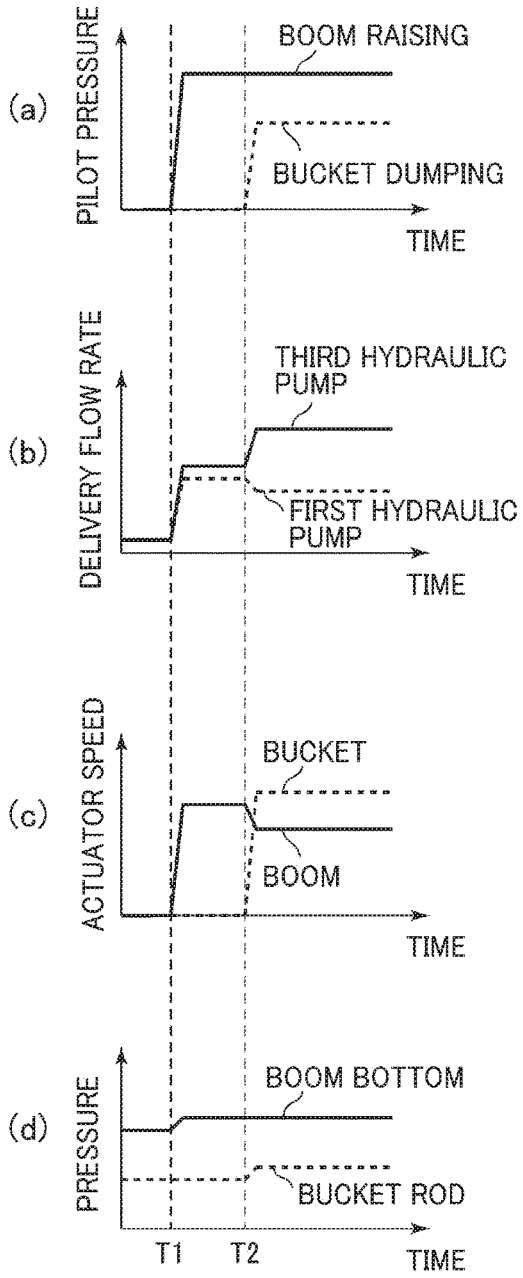
FIG. 11 is a characteristic diagram illustrating another exemplary operation related to the pump flow control means in an embodiment of the hydraulic control system for a work machine in accordance with the present invention.
Figure 12:
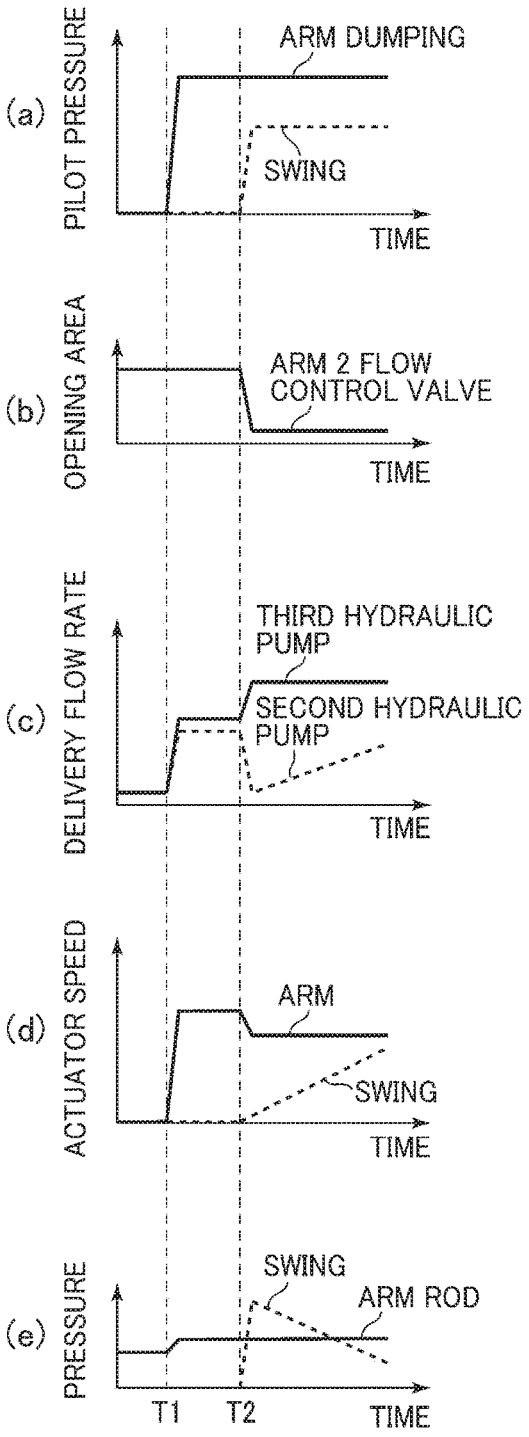
FIG. 12 is a characteristic diagram illustrating an exemplary operation related to the pump flow control means and communication control means in an embodiment of the hydraulic control system for a work machine in accordance with the present invention.
Figure 13:
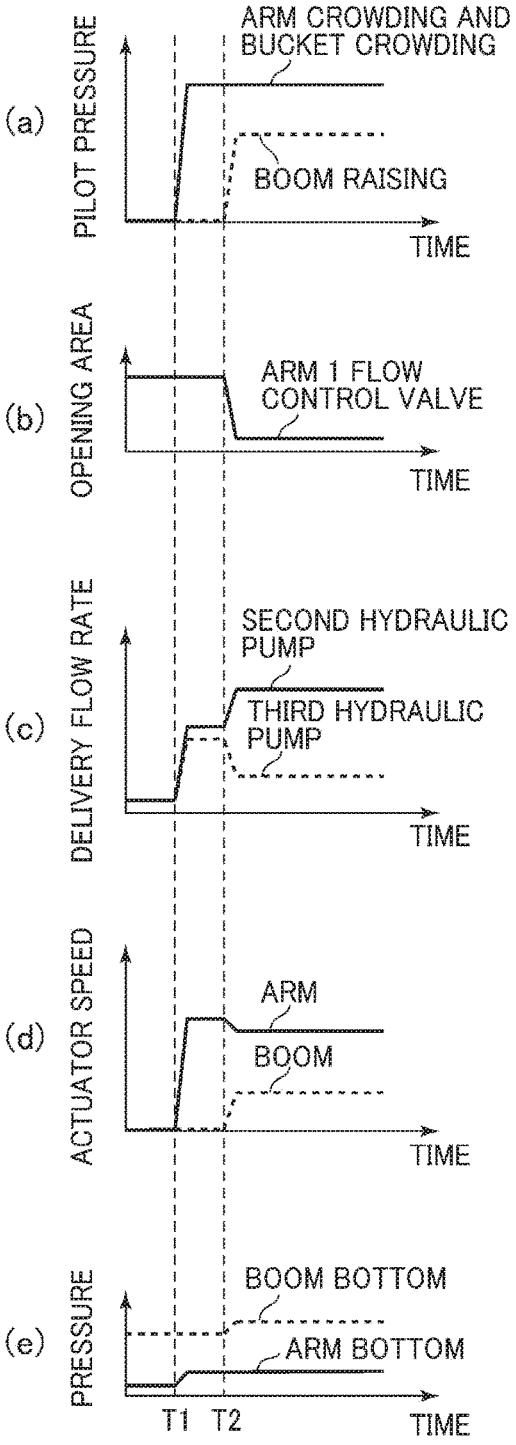
FIG. 13 is a characteristic diagram illustrating another exemplary operation related to the pump flow control means and communication control means in an embodiment of the hydraulic control system for a work machine in accordance with the present invention.

Operations of an embodiment of the hydraulic control system for a work machine will now be described in accordance with the present invention. FIG. 10 is a characteristic diagram illustrating an exemplary operation related to the pump flow control means in an embodiment of the hydraulic control system for a work machine in accordance with the present invention. FIG. 11 is a characteristic diagram illustrating another exemplary operation related to the pump flow control means in an embodiment of the hydraulic control system for a work machine in accordance with the present invention. FIG. 12 is a characteristic diagram illustrating an exemplary operation related to the pump flow control means and communication control means in an embodiment of the hydraulic control system for a work machine in accordance with the present invention. FIG. 13 is a characteristic diagram illustrating another exemplary operation related to the pump flow control means and communication control means in an embodiment of the hydraulic control system for a work machine in accordance with the present invention.

FIG. 10 is a characteristic diagram illustrating an exemplary operation that is performed when arm crowding is conducted during a boom raising operation.

In FIG. 10, the horizontal axis represents time, and the vertical axis represents (a) a pilot pressure, (b) the delivery flow rate of a hydraulic pump, (c) an actuator speed, and (d) an actuator pressure. In (a), the solid line indicates boom raising pilot pressure characteristics, and the broken line indicates the arm crowding pilot, pressure characteristics. In (b), the solid line indicates the delivery flow rate characteristics of the first hydraulic pump 20*a*, and the broken line indicates the delivery flow rate characteristics of the third hydraulic pump 20*c*. In (c), the solid line indicates the actuator speed characteristics of the boom cylinder 6, and the broken line indicates the actuator speed characteristics of the arm cylinder 7. In (d), the solid line indicates the bottom oil chamber pressure characteristics of the boom cylinder 6, and the broken line indicates the bottom oil chamber pressure characteristics of the arm cylinder 7. Time T1 is the time at which a boom raising operation is started. Time T2 is the time at which an arm crowding operation is started.

First of all, when a boom raising operation starts at time T1, the boom raising pilot pressure rises as indicated in (a). The first hydraulic pump 20*a* and the third hydraulic pump 20*c* then communicate with the bottom oil chamber of the boom cylinder 6 such that the delivery flow rates of the first and third hydraulic pumps 20*a*, 20*c* increase in accordance with the boom raising pilot pressure as indicated in (b). This causes the boom 3 to operate. As a result, the actuator speed of the boom cylinder 6 increases as indicated in (c), and the bottom oil chamber pressure of the boom cylinder 6 increases as indicated in (d).

Next, when an arm crowding operation starts at time T2, the arm crowding pilot pressure rises as indicated in (a). The second hydraulic pump 20*b* and the third hydraulic pump 20*c* then communicate with the bottom oil chamber of the arm cylinder 7. During an aerial operation, the delivery hydraulic fluid from the third hydraulic pump 20*c* is supplied to the arm cylinder 7 without being significantly divided because the bottom oil chamber pressure of the boom cylinder 6 is higher than that of the arm cylinder 7 as indicated in (d).

In the above instance, as indicated in FIG. 10, the flow control section 130 of the hydraulic control system according to the present embodiment decreases the boom 2 spool target flow rate in accordance with the arm crowding pilot pressure and increases the boom 1 spool target flow rate. As a result, the delivery flow rate of the first hydraulic pump 20*a* becomes higher as compared to a period before time T2 as indicated in (b). Therefore, a decrease in the boom raising speed can be reduced as indicated in (c) without dividing the delivery hydraulic fluid from the third hydraulic pump 20*c*. In this instance, the bottom oil chamber pressure of the arm cylinder 7 increases as indicated in (d).

If, in a situation where two hydraulic actuators (boom cylinder 6 and arm cylinder 7) operate in a combined manner, the boom cylinder 6 is regarded as the first hydraulic actuator, a hydraulic pump communicating with the first and second hydraulic actuators through different spools is defined as the other hydraulic pump. In the above-described operation, the third hydraulic pump 20*c* corresponds to the other hydraulic pump.

Further, a hydraulic pump communicating with the first hydraulic actuator (boom cylinder 6) through a primary spool for the first hydraulic actuator (boom first directional control valve) 13*a* is defined as the one hydraulic pump. In the above-described operation, the first hydraulic pump 20*a* corresponds to the one hydraulic pump.

Furthermore, the arm cylinder 7, which is a hydraulic actuator communicating only with the other hydraulic pump 20*c* without communicating with the one hydraulic pump 20*a*, is defined as the second hydraulic actuator.

That is to say, the first hydraulic actuator is either one of two simultaneously operated hydraulic actuators that communicates with the one hydraulic pump 20*a* through the first hydraulic actuator primary spool (boom first directional control valve) 13*a* and communicates with the other hydraulic pump 20*c* through a first hydraulic actuator secondary spool (boom second directional control valve) 13*c*.

When the above definition is formulated, the pump flow control means (flow control section 130) of the controller according to the present embodiment exercises control to increase the delivery flow rate of the one hydraulic pump (first hydraulic pump 20*a*) to a higher rate when the first hydraulic actuator (boom cylinder 6) and the second hydraulic actuator (arm cylinder 7) are simultaneously operated than when the first hydraulic actuator (boom cylinder 6) is operated and the second hydraulic actuator (arm cylinder 7) is not operated.

An operation performed when bucket dumping is conducted during a boom raising operation will now be described with reference to FIG. 11.

In FIG. 11, the horizontal axis represents time, and the vertical axis represents (a) a pilot pressure, (h) the delivery flow rate of a hydraulic pump, (c) an actuator speed, and (d) an actuator pressure. In (a), the solid line indicates the boom raising pressure characteristics, and the broken line indicates bucket dumping pilot pressure characteristics. In (b), the solid line indicates the delivery flow rate characteristics of the third hydraulic pump 20*c*, and the broken line indicates the delivery flow rate characteristics of the first hydraulic pump 20*a*. In (c), the solid line indicates the actuator speed characteristics of the boom cylinder 6, and the broken line indicates the actuator speed characteristics of the bucket cylinder 8. In (d), the solid line indicates the bottom oil chamber pressure characteristics of the boom cylinder 6, and the broken line indicates the rod oil chamber pressure characteristics of the bucket cylinder 8. Time T1 is the time at which a boom raising operation is started. Time T0 is the time at which a bucket dumping operation is started. Operations that are indicated in FIG. 11 and performed before time T0 are the same as those described with reference to FIG. 10 and will not be redundantly described.

When a bucket dumping operation starts at time T2, the bucket dumping pilot pressure rises as indicated in (a). The first hydraulic pump 20*a* then communicates with the rod oil chamber of the bucket cylinder 8. During an aerial operation, the delivery hydraulic fluid from the first hydraulic pump 20*a* is supplied to the bucket cylinder 8 without being significantly diverged because the bottom oil chamber pressure of the boom cylinder 6 is higher than the rod oil chamber pressure of the bucket cylinder 8 as indicated in (d).

In the above instance, as indicated in FIG. 7, the flow control section 130 of the hydraulic control system according to the present embodiment increases the boom 2 spool target flow rate in accordance with the bucket dumping pilot pressure and decreases the boom 1 spool target flow rate. As a result, the delivery flow rate of the third hydraulic pump 20*c* becomes higher as compared to a period before time T2 as indicated in (b). Therefore, a decrease in the boom raising speed can be reduced as indicated in (c) without dividing the delivery hydraulic fluid from the first hydraulic pump 20*a*. In this instance, the rod oil chamber pressure of the bucket cylinder 8 increases as indicated in (d).

If, in a situation where two hydraulic actuators (boom cylinder 6 and bucket cylinder 8) operate in a combined manner, the boom cylinder 6 is regarded as the first hydraulic actuator, a hydraulic pump communicating with the first and second hydraulic actuators through different spools is defined as the other hydraulic pump. In the above-described operation, the first hydraulic pump 20*a* corresponds to the other hydraulic pump.

Further, a hydraulic pump communicating with the first hydraulic actuator (boom cylinder 6) through a primary spool for the first hydraulic actuator (boom second directional control valve) 13*c* is defined as the one hydraulic pump. In the above-described operation, the third hydraulic pump 20*c* corresponds to the one hydraulic pump.

Furthermore, the bucket cylinder 8, which is a hydraulic actuator communicating only with the other hydraulic pump 20*a* without communicating with the one hydraulic pump 20*c*, is defined as the second hydraulic actuator.

That is to say, the first hydraulic actuator is either one of two simultaneously operated hydraulic actuators that communicates with the one hydraulic pump 20*c* through the first hydraulic actuator primary spool (boom first directional control valve) 13*a* and communicates with the other hydraulic pump 20*a* through the first hydraulic actuator secondary spool (boom second directional control valve) 13*c*.

When the above definition is formulated, the pump flow control means (flow control section 130) of the controller according to the present embodiment exercises control to increase the delivery flow rate of the one hydraulic pump (third hydraulic pump 20*c*) to a higher rate when the first hydraulic actuator (boom cylinder 6) and the second hydraulic actuator (bucket cylinder 8) are simultaneously operated than when the first hydraulic actuator (boom cylinder 6) is operated and the second hydraulic actuator (bucket cylinder 8) is not operated.

An operation performed when a swing is conducted during an arm dumping operation will now be described with reference to FIG. 12.

In FIG. 12, the horizontal axis represents time, and the vertical axis represents (a) a pilot pressure, (b) the area of an opening, (c) the delivery flow rate of a hydraulic pump, (d) an actuator speed, and (e) an actuator pressure. In (a), the solid line indicates arm dumping pilot pressure characteristics, and the broken line indicates swing pilot pressure characteristics. In (b), the solid line indicates the opening area characteristics of the arm 2 flow control valve. In (c), the solid line indicates the delivery flow rate characteristics of the third hydraulic pump 20*c*, and the broken line indicates the delivery flow rate characteristics of the second hydraulic pump 20*b*. In (d), the solid line indicates the actuator speed characteristics of the arm cylinder 7, and the broken line indicates the actuator speed characteristics of the swing hydraulic motor 11. In (e), the solid line indicates the rod oil chamber pressure characteristics of the arm cylinder 7, and the broken line indicates the supply pressure characteristics of the swing hydraulic motor. Time T1 is the time at which an arm dumping operation is started. Time 12 is the time at which a swing operation is started.

First of ail, when an arm dumping operation starts at time T1, the arm dumping pilot pressure rises as indicated in (a). The third hydraulic pump 20*c* and the second hydraulic pump 20*b* then communicate with the rod oil chamber of the arm cylinder 7 such that the delivery flow rates of the second and third hydraulic pumps 20*b*, 20*c* increase in accordance with the arm dumping pilot pressure as indicated in (c). This causes the arm 4 to operate. As a result, the actuator speed of the arm cylinder 7 increases as indicated in (d), and the rod oil chamber pressure of the arm cylinder 7 increases as indicated in (e).

Next, when a swing operation starts at time 12, the swing pilot pressure rises as indicated in W. The second hydraulic pump 20*b* then communicates with the swing hydraulic motor 11.

In the above instance, the communication control section 120 of the hydraulic control system according to the present embodiment increases the arm 2 flow control valve command pressure in accordance with the swing pilot pressure as indicated in FIG. 5, and interrupts the opening in the arm 2 flow control valve 23 as indicated in (b) of FIG. 12. This causes the delivery hydraulic fluid from the second hydraulic pump 20*b* to be supplied to the swing hydraulic motor 11 without being significantly divided.

Further, as indicated in FIG. 8, the flow control section 130 of the hydraulic control system according to the present embodiment decreases the arm 2 spool target flow rate in accordance with the arm 2 flow control valve command pressure and increases the arm 1 spool target flow rate. As a result, the delivery flow rate of the third hydraulic pump 20*c* becomes higher as compared to a period before time T2 as indicated in (c). Therefore, a decrease in the arm dumping speed can be reduced as indicated in (d) without dividing the delivery hydraulic fluid from the second hydraulic pump 20*b*. In this instance, the pressure of the swing hydraulic motor 11 increases as indicated in (e).

If, in a situation where two hydraulic actuators (arm cylinder 7 and swing hydraulic motor 11) operate in a combined manner, the arm cylinder 7 is regarded as the first hydraulic actuator, a hydraulic pump communicating with the first and second hydraulic actuators through different spools is defined as the other hydraulic pump. In the above-described operation, the second hydraulic pump 20*b* corresponds to the other hydraulic pump.

Further, a hydraulic pump communicating with the first hydraulic actuator (arm cylinder 7) through a primary spool for the first hydraulic actuator (arm first directional control valve) 14*c* is defined as the one hydraulic pump. In the above-described operation, the third hydraulic pump 20*c* corresponds to the one hydraulic pump.

Furthermore, the swing hydraulic motor 11, which is a hydraulic actuator communicating only with the other hydraulic pump 20*b* without communicating with the one hydraulic pump 20*c*, is defined as the second hydraulic actuator.

That is to say, the first hydraulic actuator is either one of two simultaneously operated hydraulic actuators that communicates with the one hydraulic pump 20*c* through the first hydraulic actuator primary spool (arm first directional control valve) 14*c* and communicates with the other hydraulic pump 20*b* through the first hydraulic actuator secondary spool (arm second directional control valve) 14*b*.

When the above definition is formulated, the pump flow control means (flow control section 130) of the controller according to the present embodiment exercises control to increase the delivery flow rate of the one hydraulic pump (third hydraulic pump 20*c*) to a higher rate when the first hydraulic actuator (arm cylinder 7) and the second hydraulic actuator (swing hydraulic motor 11) are simultaneously operated than when the first hydraulic actuator (arm cylinder 7) is operated and the second hydraulic actuator (swing hydraulic motor 11) is not operated.

An operation performed when boom raising is conducted during a combined operation of arm crowding and bucket crowding will now be described with reference to FIG. 13.

In FIG. 13, the horizontal axis represents time, and the vertical axis represents (a) a pilot pressure, (b) the area of an opening, (c) the delivery flow rate of a hydraulic pump, (d) an actuator speed, and (e) an actuator pressure. In (a), the solid line indicates arm crowding pilot pressure characteristics and bucket dumping pilot pressure characteristics, and the broken line indicates boom raising pilot pressure characteristics. In (b), the solid line indicates the opening area characteristics of the arm 1 flow control valve 22. In (c), the solid line indicates the delivery flow rate characteristics of the second hydraulic pump 20*b*, and the broken line indicates the delivery flow rate characteristics of the third hydraulic pump 20*c*. For brevity of explanation, the delivery flow rate characteristics of the first hydraulic pump 20*a* are omitted. In (d), the solid line indicates the actuator speed characteristics of the arm cylinder 7, and the broken line indicates the actuator speed characteristics of the boom cylinder 6. In (e), the solid line indicates the bottom oil chamber pressure characteristics of the arm cylinder 7, and the broken line indicates the bottom oil chamber pressure characteristics of the boom cylinder 6. Time T1 is the time at which a combined operation of arm crowding and bucket crowding is started. Time T2 is the time at which a boom raising operation is started.

First of all, when a combined operation of arm crowding and bucket crowding starts at time T1, the arm crowding pilot pressure and the bucket crowding pilot pressure rise as indicated in (a). Then, the first hydraulic pump 20*a* communicates with the bottom oil chamber of the bucket cylinder 8, and the third hydraulic pump 20*c* and the second hydraulic pump 20*b* communicate with the bottom oil chamber of the arm cylinder 7. Thus, the delivery flow rates of the second and third hydraulic pumps 20*b*, 20*c* increase in accordance with the arm crowding pilot pressure and the bucket crowding pilot pressure as indicated in (c). This causes the arm 4 and the bucket 5 to operate. As a result, the actuator speed of the arm cylinder 7 increases as indicated in (d), and the bottom oil chamber pressure of the arm cylinder 7 increases as indicated in (e).

Next, when a boom raising operation starts at time T2, the boom raising pilot pressure rises as indicated in (a). The first and third hydraulic pumps 20*a*, 20*c* then communicate with the bottom oil chamber of the boom cylinder 6. When the bottom oil chamber pressure of the bucket cylinder 8 is low, the delivery hydraulic fluid from the first hydraulic pump 20*a* is supplied to the bucket cylinder 8 without being significantly divided.

In the above instance, the communication control section 120 of the hydraulic control system according to the present embodiment increases the arm 1 flow control valve command pressure in accordance with the boom raising pilot pressure as indicated in FIG. 5, and interrupts the opening in the arm 1 flow control valve 22 as indicated in (b) of FIG. 13. This causes the delivery hydraulic fluid from the third hydraulic pump 20*c* to be supplied to the boom cylinder 6 without being significantly divided.

Further, as indicated in FIG. 8, the flow control section 130 of the hydraulic control system according to the present embodiment increases the arm 2 spool target flow rate in accordance with the arm 1 flow control valve command pressure and decreases the arm 1 spool target flow rate. As a result, the delivery flow rate of the second hydraulic pump

20*b* becomes higher as compared to a period before time T2 as indicated in (c). Therefore, a decrease in the arm crowding speed can be reduced as indicated in (d) without dividing the delivery hydraulic fluid from each hydraulic pump. In this instance, the bottom oil chamber pressure of the boom cylinder 6 increases as indicated in (e).

If, in a situation where two hydraulic actuators (arm cylinder 7 and boom cylinder 6) operate in a combined manner, the arm cylinder 7 is regarded as the first hydraulic actuator, a hydraulic pump communicating with the first and second hydraulic actuators through different spools is defined as the other hydraulic pump. In the above-described operation, the third hydraulic pump 20*c* corresponds to the other hydraulic pump.

Further, a hydraulic pump communicating with the first hydraulic actuator (arm cylinder 7) through a primary spool for the first hydraulic actuator (arm second directional control valve) 14*b* is defined as the one hydraulic pump. In the above-described operation, the second hydraulic pump 20*b* corresponds to the one hydraulic pump.

Furthermore, the boom cylinder 6, which is a hydraulic actuator communicating only with the other hydraulic pump 20*c* without communicating with the one hydraulic pump 20*b*, is defined as the second hydraulic actuator.

That is to say, the first hydraulic actuator is either one of two simultaneously operated hydraulic actuators that communicates with the one hydraulic pump 20*b* through the first hydraulic actuator primary spool (arm second directional control valve) 14*b* and communicates with the other hydraulic pump 20*c* through the first hydraulic actuator secondary spool (arm first directional control valve) 14*c*.

When the above definition is formulated, the pump flow control means (flow control section 130) of the controller according to the present embodiment exercises control to increase the delivery flow rate of the one hydraulic pump (second hydraulic pump 20*b*) to a higher rate when the first hydraulic actuator (arm cylinder 7) and the second hydraulic actuator (boom cylinder 6) are simultaneously operated than when the first hydraulic actuator (arm cylinder 7) is operated and the second hydraulic actuator (boom cylinder 6) is not operated.

According to an embodiment of the present invention, the hydraulic control system for a work machine includes the first hydraulic actuator, the one hydraulic pump, the second hydraulic actuator, the other hydraulic pump, and the secondary spool for the first hydraulic actuator. The one hydraulic pump is capable of supplying hydraulic fluid to the first hydraulic actuator through the primary spool for the first hydraulic actuator. The other hydraulic pump is capable of supplying hydraulic fluid to the second hydraulic actuator through the primary spool for the second hydraulic actuator. The secondary spool for the first hydraulic actuator is capable of placing the first hydraulic actuator in communication with the other hydraulic pump. When the first and second hydraulic actuators are simultaneously operated, the delivery flow rate of the one hydraulic pump increases to a higher rate than when the first hydraulic actuator is operated and the second hydraulic actuator is not operated. Therefore, it is possible to reduce a decrease in the speed of the first hydraulic actuator that is caused by the operation of the second hydraulic actuator. Further, in the above instance, the opening for communication between the first hydraulic actuator and the second hydraulic pump is interrupted. Consequently, the amount of divided flow of the delivery hydraulic fluid from the second hydraulic pump can be decreased to reduce the flow division loss.

The present invention is not limited to the above-described exemplary embodiments, but extends to various modifications that nevertheless fall within the scope of the present invention. The foregoing embodiments have been described in detail to facilitate the understanding of the present invention. The present invention is not necessarily limited to a configuration having all the above-described elements.

DESCRIPTION OF REFERENCE NUMERALS

1: Lower travel structure
2: Upper swing structure
2A: Engine
3: Boom.
4: Arm
5: Bucket
6: Boom cylinder
7: Arm cylinder
8: Bucket cylinder
9: Operating lever (operating device)
10: Control valve
11: Swing hydraulic motor
13*a*: Boom first directional control valve (spool)
13*c*: Boom second directional control valve (spool)
14*b*: Arm second directional control valve (spool)
14*c*: Arm first directional control valve (spool)
15*a*: Bucket directional control valve (spool)
16*b*: Swing directional control valve (spool)
20: Hydraulic pump device
20*a*: First hydraulic pump
20*b*: Second hydraulic pump
20*c*: Third hydraulic pump
20*d*: First hydraulic pump regulator
20*e*: Second hydraulic pump regulator
20*f*: Third hydraulic pump regulator
21*a*: First pump line
21*b*: Second pump line
21*c*: Third pump line
22: Arm 1 flow control valve
23: Arm 2 flow control valve
100: Controller
101-108: Pilot pressure sensor (operating instruction detection means)
110: Target operation computation section
120: Communication control section (communication control means)
130: Flow control section (pump flow control means)

The invention claimed is:

1. A work machine, comprising:

a first hydraulic actuator;

one hydraulic pump that is capable of supplying hydraulic fluid to the first hydraulic actuator through a first hydraulic actuator primary spool;

a second hydraulic actuator;

another hydraulic pump that is capable of supplying hydraulic fluid to the second hydraulic actuator through a second hydraulic actuator primary spool;

a first hydraulic actuator secondary spool that is capable of placing the first hydraulic actuator in communication with the another hydraulic pump;

operating instruction detection means that detects an issuance of operating instructions to the first and second hydraulic actuators; and pump flow control means that is capable of adjusting the delivery flow rate of the one hydraulic pump and the delivery flow rate of the another hydraulic pump on an individual basis in accordance with operation amounts designated by the operating instructions for the first and second hydraulic actuators, the operating instructions being detected by the operating instruction detection means, wherein, when the first and second hydraulic actuators are operated in combination after an independent operation of the first hydraulic actuator, the pump flow control means increases a target flow rate to be supplied to the first hydraulic actuator primary spool and decreases a target flow rate to be supplied to the first hydraulic actuator secondary spool, and increases the delivery flow rate of the one hydraulic pump based on the increased target flow rate and decreases the delivery flow rate of the another hydraulic pump based on the decreased target flow rate.

2. The work machine according to claim 1, further comprising:

communication control means that is capable of adjusting an opening for communication between the first hydraulic actuator and the another hydraulic pump;

wherein the communication control means interrupts the communication opening when the first and second hydraulic actuators are operated in combination.

3. The work machine according to claim 2, wherein the first hydraulic actuator is a boom cylinder, and the second hydraulic actuator is an arm cylinder or a bucket cylinder.

4. A work machine comprising:

a first hydraulic actuator;

one hydraulic pump that is capable of supplying hydraulic fluid to the first hydraulic actuator through a first hydraulic actuator primary spool;

a second hydraulic actuator;

another hydraulic pump that is capable of supplying hydraulic fluid to the second hydraulic actuator through a second hydraulic actuator primary spool;

a first hydraulic actuator secondary spool that is capable of placing the first hydraulic actuator in communication with the another hydraulic pump;

operating instruction detection means that detects an issuance of operating instructions to the first and second hydraulic actuators;

pump flow control means that is capable of adjusting the delivery flow rate of the one hydraulic pump and the delivery flow rate of the another hydraulic pump on an individual basis in accordance with operation amounts designated by the operating instructions for the first and second hydraulic actuators, the operating instructions being detected by the operating instruction detection means; and communication control means that is capable of adjusting an opening for communication between the first hydraulic actuator and the another hydraulic pump, wherein, when the first and second hydraulic actuators are operated in combination, the pump flow control means increases the delivery flow rate of the one hydraulic pump to a higher rate than when the first hydraulic actuator is operated and the second hydraulic actuator is not operated, wherein the communication control means interrupts the communication opening when the first and second hydraulic actuators are operated in combination, wherein the first hydraulic actuator is a boom cylinder, and wherein the second hydraulic actuator is an arm cylinder or a bucket cylinder.

* * * * *